United States Patent [19]

Soderlund

[11] Patent Number: 4,636,083

[45] Date of Patent: Jan. 13, 1987

[54] ARRANGEMENT IN CONTAINERS INTENDED TO HOLD PUMPABLE SUBSTANCES AND PROVIDED WITH A PUMP HEREFOR

[75] Inventor: Bjorn Soderlund, Huddinge, Sweden

[73] Assignee: Allman Byggnadsservice AB ABS, Farsta, Sweden

[21] Appl. No.: 743,619

[22] Filed: Jun. 11, 1985

[30] Foreign Application Priority Data

Jun. 20, 1984 [SE] Sweden ..... 8403298

[51] Int. Cl.[4] ..... B28C 7/16

[52] U.S. Cl. ..... 366/43; 366/51; 415/61

[58] Field of Search ..... 366/50, 51, 77, 190, 366/191, 195, 196, 43; 222/239, 240; 415/61, 62

[56] References Cited

U.S. PATENT DOCUMENTS 3,570,569 3/1971 Hartley et al. ..... 366/196 X 4,201,484 5/1980 Sasiela et al. ..... 366/190 X

*Primary Examiner*—Philip R. Coe

*Attorney, Agent, or Firm*—Kinzer, Plyer, Dorn & McEachran

[57] ABSTRACT

The invention relates to an arrangement in containers (1) intended to hold materials of a pumpable consistency. The arrangement comprises a reversible motor (9) which is drivably connected to a rotatable agitator (12) located in the container (1). The arrangement is characterized in that there is arranged between the agitator (12) and the pump (2) a coupling means (11) adapted to couple the agitator to the pump when the agitator is driven in a first rotational direction, and to hold the agitator disengaged from the pump when the agitator is driven in a second rotational direction, opposite to the first.

1 Claim, 3 Drawing Figures

ARRANGEMENT IN CONTAINERS INTENDED TO HOLD PUMPABLE SUBSTANCES AND PROVIDED WITH A PUMP HEREFOR

The present invention relates to an arrangement in containers intended to hold material of pumpable consistency, such as mortar or filler material, and provided with pump means, said arrangement comprising a reversible motor adapted to drive a rotable agitator located in the container.

The container pump is intended to be connected to a flexible conduit or hose, which in turn is connected to a nozzle through which the pumpable substance is laid in strings on the workpiece or working surfaces. The nozzle is provided with control means through which the motor, and therewith the pump, can be stopped, so as to interrupt the flow of material from the nozzle when desired. When the motor is stopped, the agitator will also stop, resulting in the risk of a change in the consistency of the material in the container, due to water draining from said material for example, thereby to form agglomerates in the material mass.

Consequently, a main object of the invention is to provide an arrangement of the aforesaid kind with which agitation of the material in the container can be continued when stopping the motor, so as to maintain a uniform and smooth material consistency.

Another object of the invention is to enable the reversing function of the motor serving the agitator and the pump to be utilized firstly to continuously drive the agitator and secondly briefly to reverse the pump when said pump has the form of a screw rotor pump.

Figure 1:
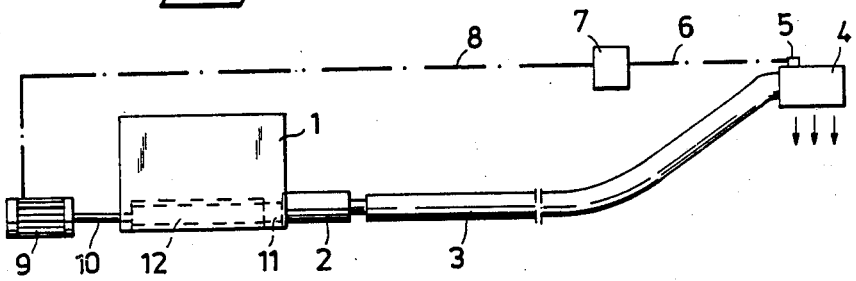
Figure 3:
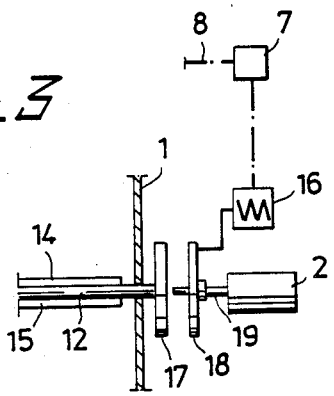
Figure 2:
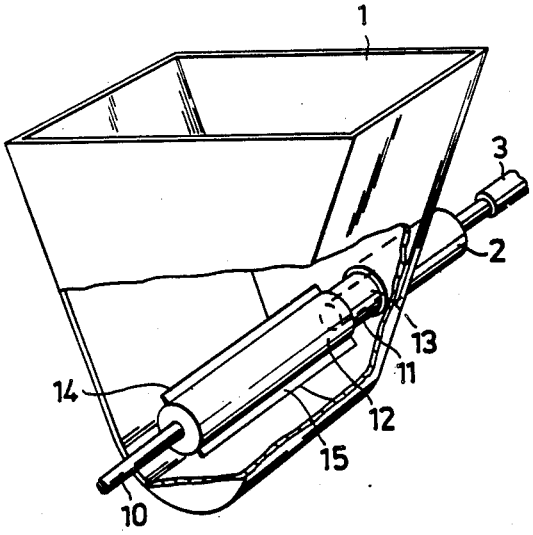

These objects are achieved in full by means of the invention defined in the followed claims and described hereinafter with reference to embodiments thereof illustrated in the accompanying drawing, in which FIG. 1 is a simplified illustration of part of a material extrusion or spray plant incorporating the invention;

FIG. 2 is a simplified illustration, in perspective, of a trough-like container forming part of the plant illustrated in FIG. 1 and incorporating the invention; and FIG. 3 illustrates a modified form of coupling means.

FIG. 1 illustrates a container for holding pumpable material, such as mortar, filler or some other pumpable material used in the building industry. The container is provided with a screw pump 2 adapted to pump the material held in the container. The invention is not restricted to just this type of pump however, and any suitable type of pump can be used. The outlet of the pump 2 is connected to a conduit 3, for example a flexible hose, through which the material is pumped to a nozzle 4 and leaves the nozzle in the direction of the arrows. In the illustrated embodiment the nozzle 4 is provided with a finger-operated control button 5 which when activated produces a signal which is sent to a control station 7 via a line 6. The control center or station 7 is adapted to control the motor 9 of the pump 2 over a line 8, this motor being of the reversible kind. The control center 7 is constructed to start the motor 9 in response to receiving a first signal produced when depressing the button 5, so as to drive an agitator or stirrer 12 arranged in the container 1, via a shaft 10. The agitator 12 is connected to the pump 2 through a coupling 11. Upon receiving the next signal the motor stops and reverses to drive the agitator or stirrer in the opposite direction. The coupling 11 of the illustrated embodiment is assumed to be a so-called idler or coaster hub which comprises two parts and which is adapted to transmit a driving force to the pump 2 in solely one direction of rotation, i.e. upon receipt of the aforesaid first signal in the control center 7 and the motor 9 consequently drives in a first rotational direction, this direction being referred to hereinafter as the pumping direction. As before mentioned, in response to the next signal the rotation of the motor 9 is reversed and the agitator 12 is subsequently rotated in a reverse direction, therewith ensuring that the material in the container 1 is worked continuously. In this reversed direction of the motor the coupling 11 does not transfer a driving force to the pump and consequently no material will be fed to the nozzle 4.

As will be seen from FIG. 2, the agitator or stirrer 12 comprises a hollow cylinder which incorporates at the end thereof located nearest the pump 2 a first hub-part while the other hub-part, which also forms a drive shaft 13, is connected to the shaft of the pump 2. The hollow cylinder 12 of the illustrated embodiment is provided with two diametrically opposed vanes 14, 15 which extend along the whole length of the cylinder. The journal means supporting the agitator 12 at the ends of the container 1 are not shown.

It will be understood that there may be used alternatively a steel shaft of small diameter having agitating or stirring means mounted thereon, and that the coaster hub 11 may be located externally of the container 1.

FIG. 3 illustrates very simply a disc clutch 17, 18 which is operated by electromagnetic control means 16. This control means receives the first signal, the pumping signal, from the control center 7 and, in response thereto, moves the movable friction clutch-plate 18 out of engagement with the friction plate 17 attached firmly to the agitator, subsequent to a given time delay, for example a delay of 10 seconds. The movable clutch plate 18 is slidably mounted on the drive shaft 19 of the pump 2, said shaft being provided with grooves which co-act with lands on the hub of the movable friction plate 18.

The aforesaid delay in clutch disengagement causes the reversed motor 9 to drive the pump 2 against the pumping direction, whereupon material is withdrawn by suction from the conduit 3, relieving the pressure thereon. The clutch 17, 18 is again engaged upon receipt of the next signal.

It will be understood that although the motor and the clutch means 17, 18 of the described embodiment are assumed to be operated electrically they can also be operated by purely mechanical means, such as by Bowden-type cables or like devices.

The described clutch means 17, 18 may also be replaced with other suitable known clutch or coupling forms, such as a jaw clutch or dog clutch.

I claim:

1. An apparatus for agitating and pumping material such as mortar or a filler which contains a liquid which can separate from the material, the apparatus including a container (1) for holding the material to be agitated and pumped, a pump (2) for pumping material from the container (1), a flexible conduit (3) connected to the output of the pump (2), a reversible motor (9), a rotatable agitator (12) located in the container (1) for agitating the material therein and drivably connected to the reversible motor (9), the reversible motor (9) adapted to drive the pump to pump material from the container into the flexible conduit (3) during a first direction of rotation of the motor (9) and to rotate the agitator in both the first and second directions of the rotation of the motor, a coupling means (17, 18) arranged between the pump (2) and the agitator (12) and including a first coupling element (17) fixed for rotation with the agitator (12) and a second movable coupling element (18) mounted for rotation with the pump, and a control means (16) to hold the movable coupling element (18) in engagement with the first coupling element (17) for a selected period of time after the first direction of rotation of the motor (9) is reversed for the purpose of removing some of the material previously pumped into the flexible conduit (3) to relieve pressure in the flexible conduit (3) while continuing to rotate the agitator (12).

* * * * *